US007715742B2

(12) United States Patent
Burry et al.

(10) Patent No.: US 7,715,742 B2
(45) Date of Patent: May 11, 2010

(54) PHOTOCONDUCTOR LIFE THROUGH ACTIVE CONTROL OF CHARGER SETTINGS

(75) Inventors: Aaron Michael Burry, West Henrietta, NY (US); Christopher Auguste DiRubio, Webster, NY (US); Paul Charles Julien, Webster, NY (US); Eric Scott Hamby, Fairport, NY (US); Palghat Ramesh, Pittsford, NY (US); Michael F. Zona, Holley, NY (US); William C. Dean, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 665 days.

(21) Appl. No.: 11/644,276

(22) Filed: Dec. 22, 2006

(65) Prior Publication Data

US 2008/0152371 A1 Jun. 26, 2008

(51) Int. Cl.
*G03G 15/02* (2006.01)
*G03G 15/00* (2006.01)

(52) U.S. Cl. ..... 399/50; 399/48

(58) Field of Classification Search ..... 399/26, 399/48, 50, 168

See application file for complete search history.

(56) References Cited

U.S. PATENT DOCUMENTS 4,355,885 A * 10/1982 Nagashima ..... 399/50
4,731,633 A * 3/1988 Foley et al. ..... 399/168
4,748,465 A * 5/1988 Tsilibes et al. ..... 399/50
5,161,084 A * 11/1992 Morihara et al. ..... 399/168
6,611,665 B2 8/2003 DiRubio et al.
6,807,390 B2 10/2004 Suda et al.
6,917,770 B2 7/2005 Bae et al.
7,024,125 B2 4/2006 Ishii et al.
2002/0006289 A1* 1/2002 Takami et al. ..... 399/50
2002/0021912 A1* 2/2002 Tanaka et al. ..... 399/50
2002/0034394 A1* 3/2002 Matsuguma et al. ..... 399/26
2007/0189787 A1* 8/2007 Hagiwara et al. ..... 399/48
2008/0101807 A1* 5/2008 Burry et al. ..... 399/50
2008/0170869 A1* 7/2008 Ramesh et al. ..... 399/50

FOREIGN PATENT DOCUMENTS

DE 3115351 A * 4/1982
JP 56146156 A * 11/1981

* cited by examiner

*Primary Examiner*—Susan S Lee
(74) *Attorney, Agent, or Firm*—Fay Sharpe LLP

(57) ABSTRACT

Xerographic photoreceptor life is improved while maintaining output print quality by adjusting the AC charging actuator of a xerographic machine to a point at which photoconductor life is optimized while maintaining output print quality. Where the actuator is voltage, the actuator is set a predetermined amount above the knee voltage of the photoreceptor surface potential versus peak-to-peak voltage curve, which is determined during operation of the machine. Instead of determining the knee voltage, calibration sheets can be generated for various values of the actuator, the best sheet with the least possible actuator value is selected, and the AC charging actuator is set to the value corresponding to the best sheet. The sheets can be evaluated by a user, or an optical array sensor can be used to scan the sheets so that the controller can compare the sheets to stored criteria to automatically select the best sheet and set the actuator. Alternatively, the optical array sensor can scan calibration images directly from the intermediate transfer belt or other image bearing member, thus eliminating the use of paper for calibration.

18 Claims, 9 Drawing Sheets

PHOTOCONDUCTOR LIFE THROUGH ACTIVE CONTROL OF CHARGER SETTINGS

CROSS-REFERENCE TO RELATED APPLICATIONS

This application is related to U.S. patent application Ser. No. 11/644,277, filed on the same date as this application, Dec. 22, 2006, invented by Christopher A. DiRubio, Mike Zona, Charles A. Radulksi, Aaron M. Burry, and Palghat Ramesh, and entitled, "Method of Using Biased Charging/Transfer Roller as In-Situ Voltmeter and Photoreceptor Thickness Detector," the disclosure of which is hereby incorporated by reference.

This application is also related to U.S. Pat. No. 6,611,665 to Christopher A. DiRubio et. al., is co-owned, and shares at least one common inventor with the patent. The '665 patent discloses a method and apparatus for using a biased transfer roller as a dynamic electrostatic voltmeter for system diagnostics and closed loop process controls and its disclosure is hereby incorporated by reference.

BACKGROUND AND SUMMARY

Xerographic reproduction apparatus use a photoreceptor in the form of a drum or a belt in the creation of electrostatic images upon which toner is deposited and then transferred to another belt or drum, or to paper or other media. Once the toner image is transferred, most xerographic apparatus clean the photoreceptor in ways that can abrade the surface, changing the thickness of the photoreceptor over time. Even without such abrasion, the thickness of the photoreceptor will decrease through use over time, typically through contact friction with various other devices in the system, such as the transfer roller. See, for example, the "Nominal" curve in FIG. 6, which shows a graph of charge transport layer thickness reduction versus print count. Because of the nature of the photoreceptor, a change in its thickness will result in a change in its electrostatic performance.

After enough of the surface layer of the photoconductor has been worn away, print quality defects will typically begin to appear. For example, with organic photoconductor drums, charge depleted spots (CDS) can appear in the output prints after enough of the photoconductor outer layer, which is the charge transport layer (CTL), has been worn away. To avoid these sorts of defects, some xerographic devices use a page counter and simply stop using the photoconductor, or at least signal that the photoconductor should be replaced, after a predetermined number of prints have been made. Since photoconductors are typically somewhat expensive to replace, the life of these devices can have a significant impact on the overall run cost of the print engine. In fact, this can be one of the largest contributors to the parts costs for many tandem color xerographic machines.

Many xerographic engines, particularly color xerographic engines, make use of contact and/or close proximity AC charging devices, such as biased charging rollers (BCRs), such as seen in FIGS. 1-3. Contact and/or close proximity type charging devices typically use an AC waveform with a DC offset bias to exceed the required threshold voltage for air breakdown, $V_{TH}$, which varies with the particular geometry of the print engine, thereby generating the desired photoreceptor charging behavior. Although the device itself may contact the photoreceptor, contact is not a necessary condition for the corona to contact or reside in close proximity to the photoreceptor and lead to high rates of photoreceptor wear. Therefore, charging devices with air gaps between the surface of the device and the photoreceptor can also benefit from embodiments disclosed herein.

A typical response of the photoconductor potential as a function of the AC peak-to-peak voltage charging actuator is shown in FIG. 4. The location of the actuator saturation point in this curve is typically referred to as the "knee" of the charge curve (the point at which further increases in the actuator do not significantly affect the output photoconductor charge voltage). Typically, non-uniform print quality is obtained for AC charging devices when the AC peak-to-peak actuator is operated below this knee value. In addition, under certain conditions, some print quality defects may occur for actuator value close to, but still slightly above, the knee of the charge curve. One type of defect that can occur is a light and dark spots pattern (similar to a salt-and-pepper noise) that occurs between the charging knee and a $V_{p-p}$ value known as the background disappearing point ("BDP"). The speckles that appear as a result of the BDP defect are typically referred to as BDP spots. To prevent BDP spots from occurring, it is necessary to maintain the AC charging actuator at a value safely above the BDP. Thus, in most xerographic engines that make use of contact and/or close proximity AC charging devices, the charging actuator is operated at a value sufficiently far above the knee of the curve to ensure acceptable output print quality despite variations in the process.

While the BDP spots defect appears to cease to occur after a number of prints have been run, on the order of several thousand or more, depending on the particular xerographic engine and/or photoconductor, eliminating the defect from the first print is preferred. The age related effect means that, while it is necessary to steer the AC actuator slightly higher than the BDP value early in the life of the photoconductor, it is possible to reduce the AC charging actuator toward the knee of the charging curve once a particular threshold in print count has been reached.

In xerographic systems using contact and/or dose proximity AC charging devices, the rate of wear of the photoconductor is accelerated as a result of positive ion deposition onto the photoconductor surface by the charging device. These positive ions are believed to interact with the surface of the photoconductor, thereby making it more susceptible to abrasion and wear. The greater the number of positive ions deposited onto the surface of the photoconductor during charging, the more quickly the photoconductor surface material will wear. In addition, the larger the amount by which the charge knee voltage is exceeded, the larger the amounts of both positive and negative ions that will be produced during each cycle of the charging waveform. This is illustrated, for example, in FIG. 5, which shows simulation results indicating the amount of positive charge deposition onto a photoconductor as the charger actuator voltage increases above the knee value. Thus, the magnitude of the AC charging voltage applied to the charging device can significantly affect the amount of positive charge deposition that occurs on the photoconductor surface. For a given DC offset voltage, larger peak-to-peak amplitudes for the applied AC voltage above the charging knee will typically lead to larger amounts of positive charge deposited onto the PC surface for each charging cycle. Once again, the larger the amount of positive charge deposited onto the photoconductor surface by the charging device, the faster the PC surface will wear. Thus, it is highly desirable to minimize the distance of the charging actuator above the knee of the charge curve at all times.

In many xerographic systems that make use of a contact and/or close proximity AC charging device, the AC charging actuator is not actively adjusted. The AC charging actuator is typically the amplitude of the AC voltage waveform for constant voltage mode charging, or the AC current setting for constant current mode charging. However, the DC offset voltage for the AC charging device is, in many engines, adjusted as part of the normal process controls to help maintain consistent output The AC charging actuator value of many xerographic print engines is determined and set as part of the initial design of the engine. The AC charging actuator thus remains fixed and is not actively adjusted during normal operation. Since print quality defects are known to occur for charging actuator values close to or below the knee, larger design values for the AC actuator are typically chosen to ensure that variations in the process behavior will not result in variations in the charging output voltage. However, these larger actuator values result in more positive ions being deposited onto the photoconductor's surface during each charging cycle (each cycle of the AC waveform). Once again, the wear rate of the photoconductor is related to the amount of positive charge deposition onto its surface, where an increase in positive charge deposition results in a decrease in the expected life of the photoconductor. Thus, a tradeoff is made at design time between the print quality latitude of the charging actuator and the amount of excess positive charge deposited onto the photoconductor surface, and therefore the expected wear rate of the device.

In an effort to limit the amount of positive charge deposited onto the surface of the photoconductor while maintaining acceptable output print quality, some prior methods have attempted to design different AC waveform shapes. Another technique modulates the AC waveform in different ways, and other approaches have been used. However, each of these approaches has focused on altering the design of the AC charging waveform at design time, not making any active adjustments to the AC actuator during normal operation of the print engine.

Instead, to address the need for longer life photoconductor devices in systems with contact and/or close proximity AC charging, many prior methods have focused on materials related solutions. These types of approaches can include such things as improved overcoats on the photoconductors to make them more durable. Unfortunately, these types of solutions are somewhat difficult to develop and can, in fact, cause other problems in the system. For example, creating a harder photoconductor surface in a xerographic system with a blade cleaning device shifts the wear to the cleaner blade, which can lead to reduced cleaning blade lives, which might not allow a significant gain in system run cost to be realized through such a materials based solution.

Still other methods have looked at using non-contact charging devices or other subsystem changes to reduce the abrasion of the photoconductor surface. For example, a non-contact charging device, such as a scorotron, applies high voltage to a wire or pin coronode located a distance, such as about 500 μm or more, from the photoreceptor surface. The charge generating corona discharge is localized around the coronode is such devices, not touching, but in relatively close proximity to the photoreceptor.

Some prior methods, such as, for example, that disclosed in U.S. Pat. No. 7,024,125, have suggested mechanisms for adjusting the charging actuator in an active fashion. However, these prior methods are limited in the information that they use to adjust the charging actuator. Such methods are typically limited to measurement of a current as a mechanism for measuring the charge level of the photoconductor. Unfortunately, for some devices, such as biased-transfer rolls, the measurement of a current using a constant voltage mode of operation can be quite noisy. For example, if the impedance of any component changes, this can have a detrimental effect on the current measurement. In addition, prior methods typically do not make use of image quality information in their adjustment of the charging actuators. Rather, these prior systems are limited to measurements only of the underlying process parameters, namely the location of the charging knee, or threshold voltage, through measurement of a downstream current flow. Thus, there is a need for a xerographic system with an active adjustment scheme that will optimize photoconductor life in a robust fashion while ensuring that charging related print quality defects do not occur.

Embodiments significantly improve the life of a photoconductor in a xerographic engine by actively adjusting the AC charger settings for contact and/or close proximity charging devices used in the engine based on measurements of the charging threshold $V_{knee}$ and also possibly based on measurements of print quality related parameters. Embodiments actively adjust the AC charging actuator (peak-to-peak voltage or AC current) to reduce the amount of positive charge deposited onto the surface of the photoconductor, thereby extending its life, as illustrated by the "Reduced BCR" curve of FIG. 6 while also maintaining an acceptable distance between the actuator setting and the knee of the charging curve and/or the required print quality defect thresholds to minimize the possibility of charging related print quality defects.

The selection of the contact and/or close proximity AC charging actuator operating value (the actuator) is very important from a photoconductor device life point of view since positive charge deposition onto the PC surface drives the PC wear rate in many xerographic systems with contact and/or close proximity AC charging devices. The charging actuator operating value is the peak-to-peak voltage value of the charging waveform for constant voltage charging devices and is the AC current value for constant current charging devices. Another concern regarding the choice of the AC charging actuator setting is the uniformity of the resultant charged voltage, $V_{high}$, on the photoconductor. Non-uniformities in $V_{high}$ can translate to undesirable non-uniformities in the output of the xerographic apparatus. Too low of an AC charging actuator value tends to result in these types of non-uniformities in the $V_{high}$ output from charging. Thus, choosing appropriate values of the AC charging actuator according to embodiments can prevent print quality defects from occurring in addition to extending photoconductor life.

To achieve embodiments, a measure of the photoreceptor surface potential is useful. Surface potential can be measured using electro-static voltmeters (ESVs) and/or the thickness of the photoconductor can be estimated using measurements from the BCR or BTR, high voltage power supply, such as with the techniques disclosed in U.S. patent Ser. No. 11/644,277, filed concurrently herewith and incorporated by reference above. However, ESVs can be costly to implement in engines that do not already include ESVs, particularly in color xerographic apparatus including multiple photoreceptors and/or marking engines. U.S. Pat. No. 6,611,665 to DiRubio et al., as well as U.S. patent application Ser. No. 11/644,277, incorporated by reference above, discloses a method and apparatus using a biased transfer roll as a dynamic electrostatic voltmeter for system diagnostics and closed loop process controls. While the techniques disclosed in the '665 patent are useful, they can suffer inaccuracies due to unpredictable aging effects of the elastomers used in the BTR, as well as other factors. Such measurements are more accurate than those obtained by prior methods, such as that disclosed in U.S. Pat. No. 7,024,125 discussed above, which employs a constant voltage mode operation. Thus, the method of using a biased charging roller as disclosed in U.S. patent application Ser. No. 11/644,277, incorporated by reference above, is preferred for accuracy when possible. Using the measures of photoreceptor surface potential ($V_{PC}$), the knee location can be determined, and embodiments can adjust the AG actuator accordingly. The routine of embodiments can be run periodically, such as during cycle-up or cycle-down or every so many prints, to ensure consistent output of the xerographic apparatus in which it is used.

To achieve embodiments, a measure of the occurrence and/or level of charging related print quality defects is also useful These measurements can be obtained using a variety of techniques and sensors. For example, in situ scan bar sensors can be used in the xerographic printing engine to detect structured image print quality defects, such as CDS and BDP defects. These sensors could be used to detect the occurrence, size, and other properties related to such print quality defects.

DESCRIPTION

Figure 1:
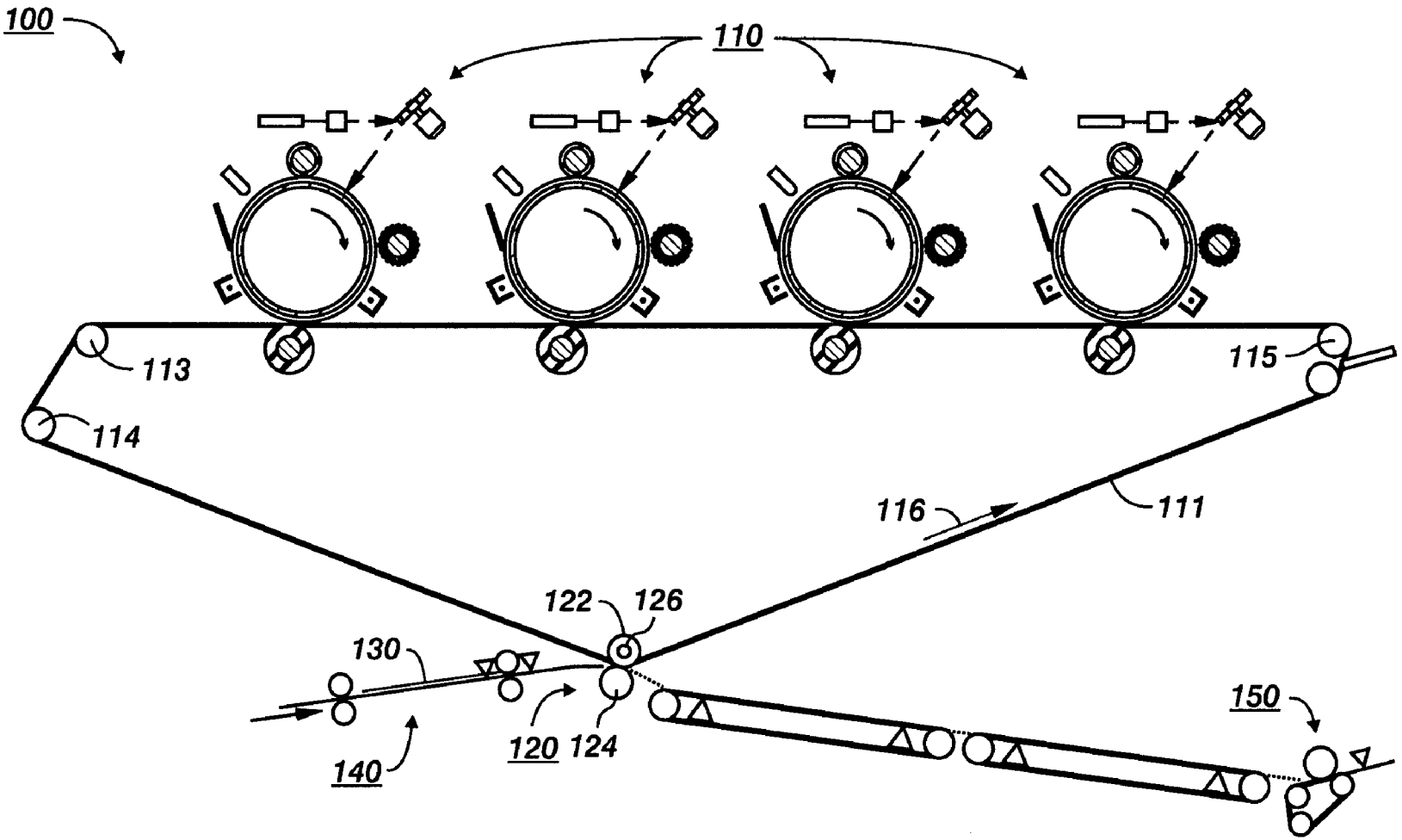
FIG. 1 is a schematic representation of a xerographic apparatus in which embodiments can be employed.

Referring to FIG. 1, a xerographic apparatus 100, such as a copier or laser printer, is shown schematically, incorporating features of embodiments. Although embodiments will be described with reference to the embodiment shown in the drawings, it should be understood that embodiments can be employed in many alternate forms. In addition, any suitable size, shape or type of elements or materials could be used without departing from the spirit of the invention.

As shown in FIG. 1, the xerographic apparatus 100 generally includes at least one image forming apparatus 110, each of substantially identical construction, that can apply a color of toner (or black). In the example of FIG. 1, there are four image forming apparatus 110 which can apply, for example, cyan, magenta, yellow, and/or kappa/black toner. The image forming apparatus 110 apply toner to an intermediate transfer belt 111. The intermediate transfer belt 111 is mounted about at least one tensioning roller 113, steering roller 114, and drive roller 115. As the drive roller 115 rotates, it moves the intermediate transfer belt 111 in the direction of arrow 116 to advance the intermediate transfer belt 111 through the various processing stations disposed about the path of the belt 111. Once the toner image has been completed on the belt 111 by having toner deposited, if appropriate, by each imaging apparatus 110, the complete toner image is moved to the transfer station 120. The transfer station 120 transfers the toner image to paper or other media 130 carried to the transfer station by transport system 140. The media then passes through a fusing station 150 to fix the toner image on the media 130. Many xerographic printers 100 use at least one biased transfer roller 124 for transferring imaged toner to sheet-type media 130 as shown and according to embodiments, though it should be understood that embodiments can be employed with continuous rolls of media or other forms of media without departing from the broader aspects of embodiments. U.S. Pat. No. 3,781,105, the disclosure of which is hereby incorporated by reference, discloses some examples of a biased transfer roller that can be used in a xerographic printer.

As shown in FIG. 1, the transfer station 120 includes at least one backup roller 122 on one side of the intermediate transfer belt 111. The backup roller 122 forms a nip on the belt 111 with a biased transfer roller 124 so that media 130 passes over the transfer roller 124 in close proximity to or in contact with the complete toner image on the intermediate transfer belt 111. The transfer roller 124 acts with the backup roll 122 to transfer the toner image by applying high voltage to the surface of the transfer roller 124, such as with a steel roller. The backup roller 122 is mounted on a shaft 126 that is grounded, which creates an electric field that pulls the toner image from the intermediate transfer belt 111 onto the substrate 130. The sheet transport system 140 then directs the media 130 to the fusing station 150 and on to a handling system, catch tray, or the like (not shown).

Alternatively, in embodiments the backup roller 122 can be mounted on a shaft that is biased. As described above, the biased transfer roller 124 is ordinarily mounted on a shaft 126 that is grounded, which creates an electric field that pulls the toner image from the intermediate transfer belt 111 onto the substrate 130. Alternatively, the shaft of the backup roller 122 could be biased while the shaft 126 on the biased transfer roller 124 is grounded. The sheet transport system 140 then directs the media 130 to the fusing station 150 and on to a handling system, catch tray, or the like (not shown).

Figure 2:
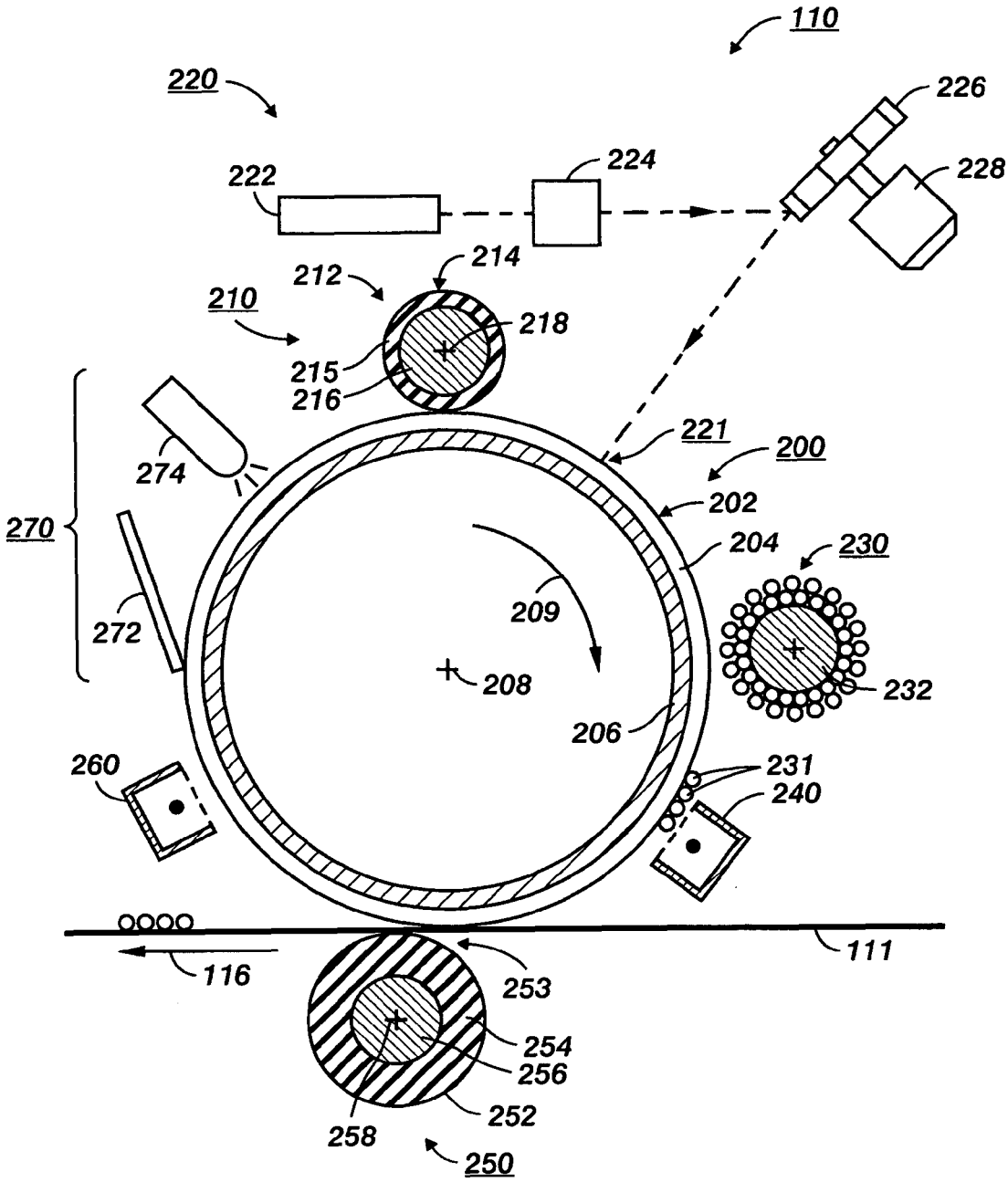
FIG. 2 is a schematic of an imaging apparatus in which embodiments can be employed, the imaging apparatus being part of a xerographic apparatus, such as that shown in FIG. 1.

Referring to one image forming apparatus 110 as an example, shown in FIG. 2, each image forming apparatus 110 includes a photoreceptor 200 (PC), a charging station or subsystem 210, a laser scanning device or subsystem 220, such as a rasterizing output scanner (ROS), a toner deposition station or subsystem 230, a pretransfer station or subsystem 240, a transfer station or subsystem 250, a precleaning station or subsystem 260, and a cleaning/erase station 270. The photoreceptor 210 of embodiments is a drum, but other forms of photoreceptor could conceivably be used. The photoreceptor drum 210 of embodiments includes a surface 202 of a photoconducting layer 204 on which an electrostatic charge can be formed. The photoconducting layer 204 can be mounted or formed on a cylinder 206 that is mounted for rotation on a shaft 208, such as in the direction of the arrow 209.

Figure 3:
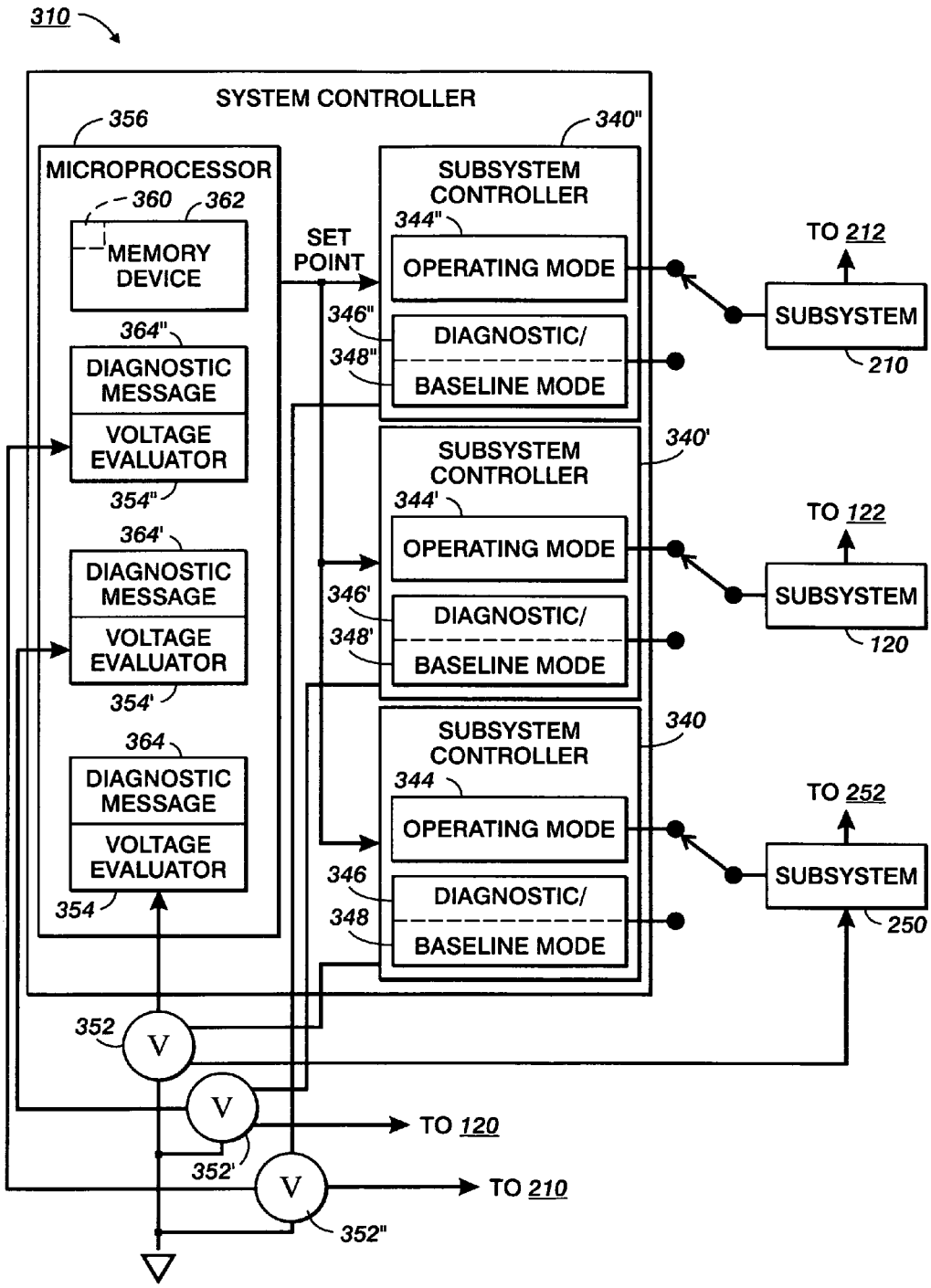
FIG. 3 is a schematic of the components employed in embodiments.

The charging station 210 of embodiments includes a biased charging roller 212 that charges the photoreceptor 200 using a DC-biased AC voltage supplied by a high voltage power supply (shown in FIG. 3). The biased charging roller 212 includes a surface 214 of an elastomeric layer 215 formed or mounted on an inner cylinder 216, such as a steel cylinder, though any appropriate conducting material could be used. The roller 212 is preferably mounted for rotation with a shaft 218 extending therethrough along a longitudinal axis of the roller 212.

The laser scanning device 220 of embodiments includes a controller 222 that modulates the output of a laser 224, such as a diode laser, whose modulated beam shines onto a rotating mirror or prism 226 rotated by a motor 228. The mirror or prism 226 reflects the modulated laser beam onto the charged PC surface 202, panning it across the width of the PC surface 202 so that the modulated beam can form a line 221 of the image to be printed on the PC surface 202. Exposed portions of the image to be printed move on to the toner deposition station 230, where toner 232 adheres to the exposed regions of the photoconductor. The image regions of the PC, with adherent toner, then pass to the pretransfer station 240 and on to the transfer station 250.

The transfer station 250 includes a biased transfer roller 252 arranged to form a nip 253 on the intermediate transfer belt 111 with the PC 200 for transfer of the toner image onto the intermediate transfer belt 111. In embodiments, the biased transfer roller 252 includes an elastomeric layer 254 formed or mounted on an inner cylinder 256, and the roller 252 is mounted on a shaft 258 extending along a longitudinal axis of the roller 252. The biased transfer roller 252 typically carries a DC potential provided by a high voltage power supply 352, such as that seen in FIG. 3. The voltage applied to the roller 252 draws the toner image 231 from the photoreceptor surface 202 to the intermediate transfer belt 111. After transfer, the PC surface 202 rotates to the precleaning subsystem 260, then to the cleaning/erasing substation 270, where a blade 272 scrapes excess toner from the PC surface 202 and an erase lamp 274 equalizes the residual charge on the PC surface.

Referring to FIG. 3, an electronic control system 310 for the xerographic apparatus 100 can include at least one subsystem controller connected to at least one respective subsystem. In the example shown in FIG. 3, three subsystem controllers 340, 340', 340" are connected to a local transfer subsystem 250, the main transfer subsystem 120, and a charging subsystem 210, respectively. Each of the at least one subsystem controller 340, 340', 340" of embodiments includes an operating mode apparatus 344, 344', 344" and apparatus to selectively operate in diagnostic mode 346, 346', 346" and baseline mode 348, 348', 348". The controller 310 further includes a microprocessor 356 that can include a memory device 360 and can produce a diagnostic message 364, 364', 364" in response to code and to a voltage evaluator 354, 354', 354". The diagnostic message can be displayed on a user interface (not shown) of the xerographic apparatus. The microprocessor 356 is preferably connected to high voltage power supplies 352, 352', 352" for first transfer subsystem 250, second transfer subsystem 120, and the charging subsystem 210, respectively. One power supply delivers a control current and/or control voltage to the biased transfer roller 122 of the main transfer subsystem, another power supply delivers a control current and/or control voltage to one or each biased charging roller 212, and another power supply delivers a control current and/or control voltage to one or each local biased transfer roller 252. The biased charging roller 212 is often powered by a DC biased, AC high voltage power supply 352". The DC component provided to the biased charging roller 212 is typically maintained at a constant controlled voltage, while the AC component is typically operated at a constant controlled current. The biased transfer roller 252 is often powered by a DC high voltage power supply 352' that is operated in either constant controlled current or constant controlled voltage mode. The voltage or current set point(s) of either the charging or transfer roller can be varied over time.

As described generally above, embodiments actively adjust the AC charging actuator of the xerographic print engine. In the example apparatus shown in FIGS. 1-4, the AC-biased charging roller 212 can be used in either constant current or constant voltage mode, and either of these can be adjusted as needed to simultaneously optimize the xerographic output and the photoreceptor life. It should be noted that embodiments can be used in any appropriate contact and/or close proximity AC charging device situation as also mentioned above. As noted, the charging device need not contact the photoreceptor in this class of devices, but the corona discharge itself can be in close proximity, such as 500 μm or less, to the photoreceptor surface.

Figure 4:
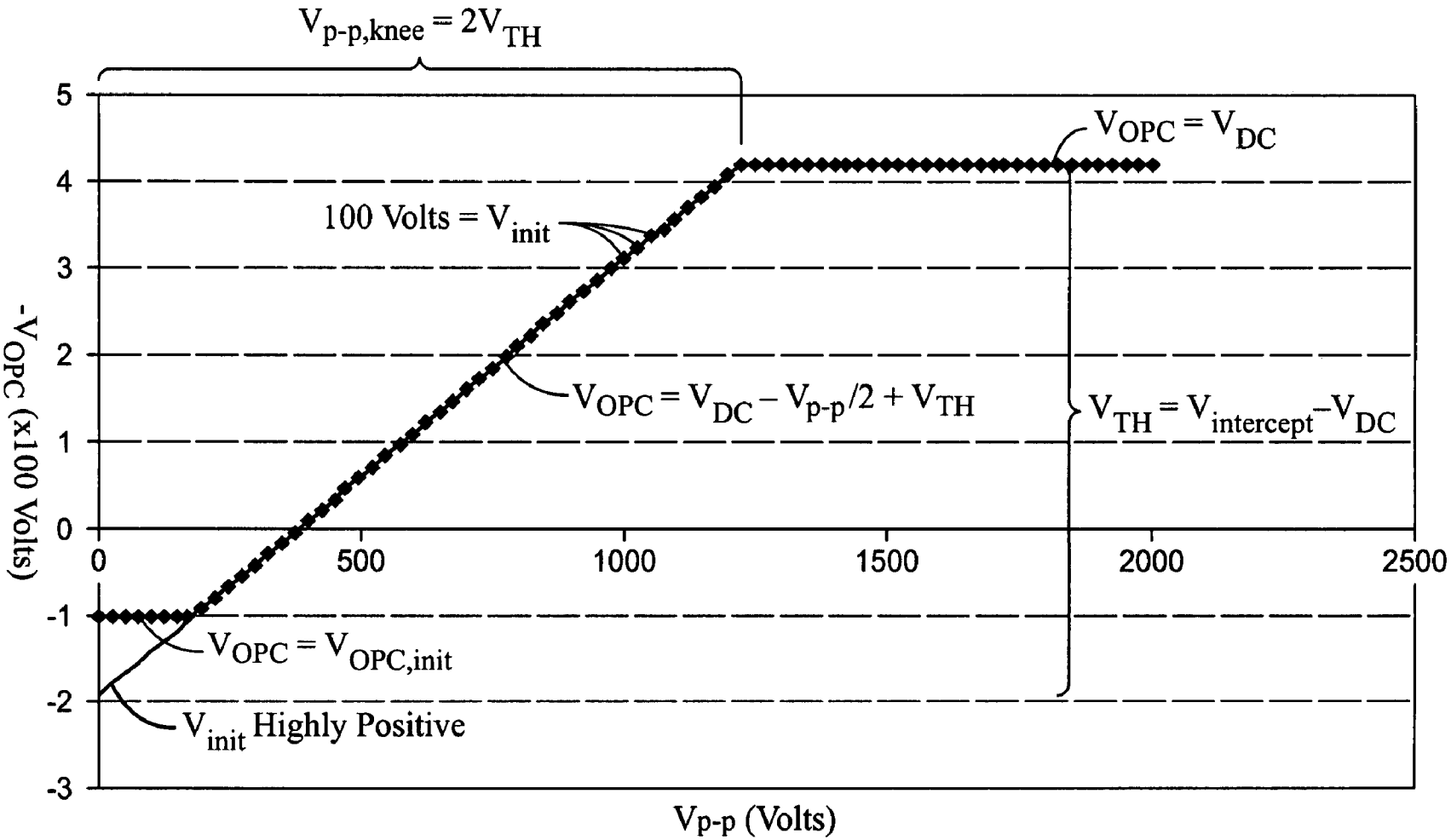
FIG. 4 is a graph of photoreceptor surface potential versus peak-to-peak bias charging roller voltage, $V_{p-p}$.
Figure 5:
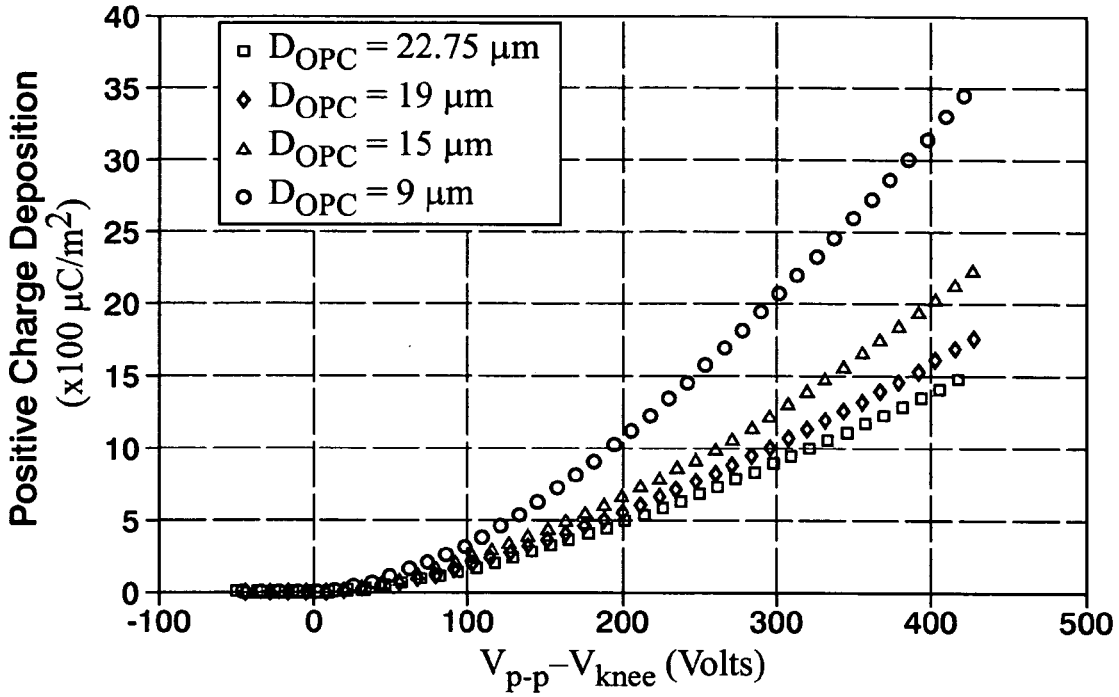
FIG. 5 is a graph of positive charge deposition versus the difference between $V_{p-p}$ and $V_{knee}$.
Figure 6:
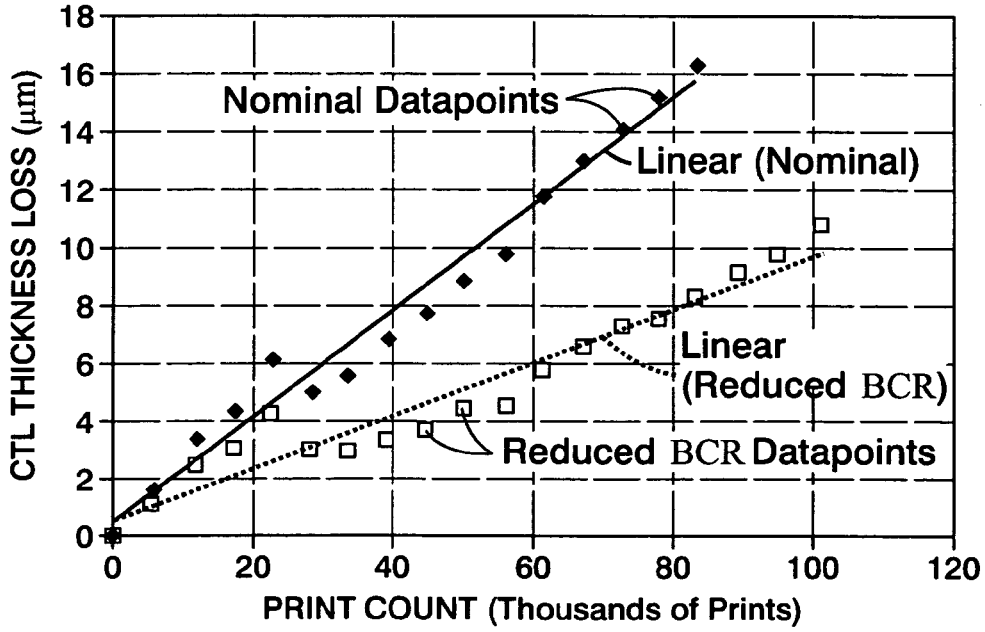
FIG. 6 is a graph of photoreceptor/charge transport layer thickness loss versus print count for a typical xerographic machine compared to that for a xerographic machine using AC actuator adjustment according to embodiments.

To properly adjust the AC charging actuator, the charging knee on the AC peak-to-peak voltage versus photoreceptor surface potential curve is preferably first determined in embodiments. Such a curve is shown in FIG. 4 as an example, which includes markings to assist with the explanations of various methods of determining the knee value. The design knee value or the DC bias voltage value can be used to establish ranges in which the surface voltage for a given series of peak-to-peak voltages can be measured to determine the actual knee value. Once the actual knee value is known, measurements of print quality related defects can then be made and used to guide the appropriate selection of the charging actuator. Thus, embodiments can employ the charging knee value and print quality defect measurements to establish a suitable operating actuator voltage that can increase photoconductor life and enhance print quality simultaneously.

As seen in the exemplary curve in FIG. 4, the AC peak-to-peak voltage curve slope remains zero until the threshold voltage for air breakdown, $V_{TH}$, is exceeded by the charger bias voltage. Once the threshold voltage has been achieved, the output photoconductor voltage increases linearly with the input AC charging actuator. This relationship continues until a maximum photoreceptor voltage is achieved, after which point increasing the peak-to-peak voltage of the charging roller does not significantly change the photoreceptor surface voltage. This point of transition to a maximum PC voltage is the "knee" in the curve. The maximum PC charged voltage is typically equal to, or slightly less than, the DC bias voltage applied to the charging roller. The actuator value at the knee of the charge curve is also substantially equal to twice the threshold voltage where air breakdown occurs.

Figure 8:
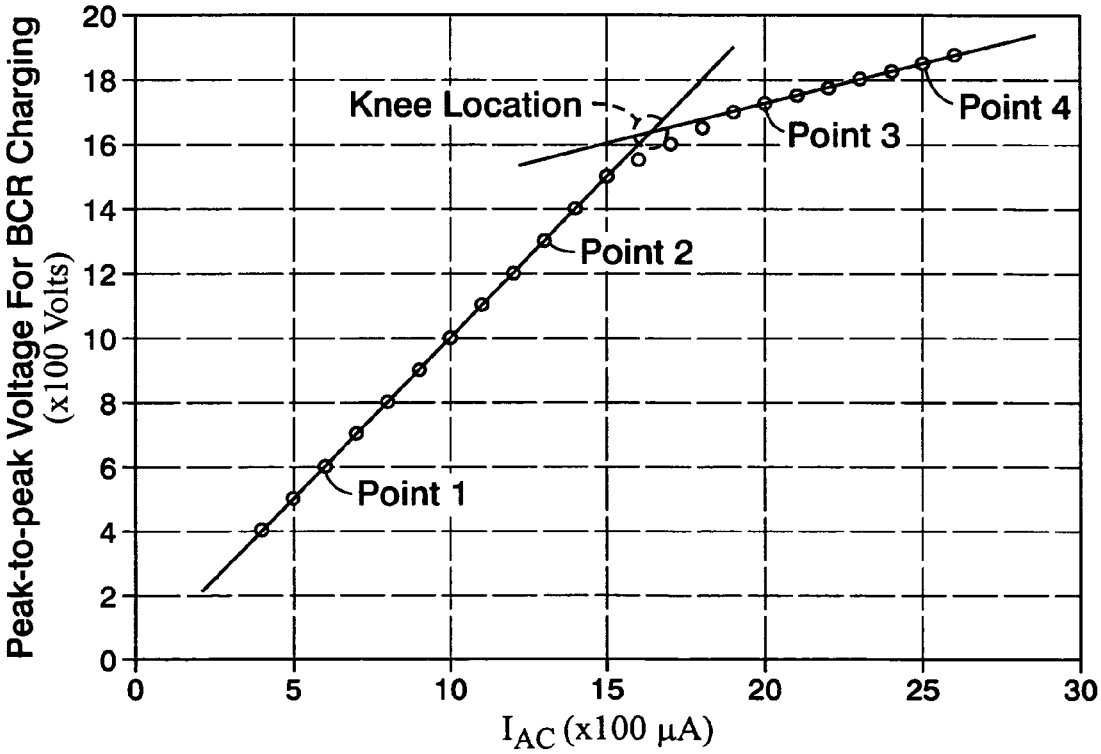
FIG. 8 is a graph of AC charging actuator (current) versus $V_{p-p}$ according to embodiments.

As seen in FIG. 8, the peak-to-peak voltage $V_{p\text{-}p}$ has a substantially linear relationship with the charging actuator (current) on either side of the charging knee, $V_{p\text{-}p,\ knee}$. The slope differs on either side of the knee, which allows an additional method of determining the value of $V_{p\text{-}p,\ knee}$, as will be described below.

Figure 9:
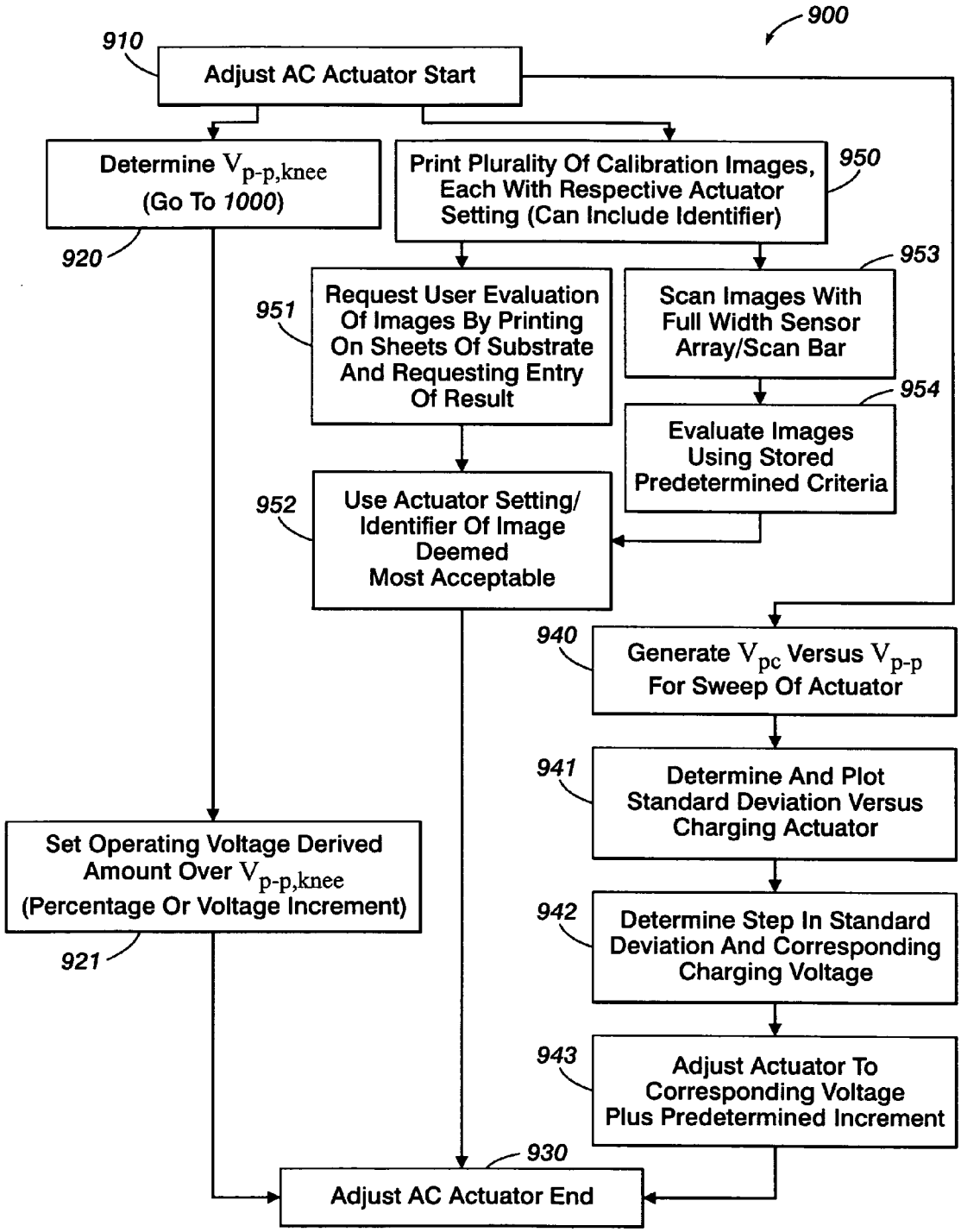
FIG. 9 is a schematic flow diagram of a method of adjusting AC actuator according to embodiments.

Thus, with reference to FIG. 9, a method of adjusting the AC charging actuator 900 can start 910 with determining the knee voltage value 920 and then setting the operating charging actuator at some predetermined interval above the knee value 921. The desired voltage difference between the charging knee and the choice of the charging actuator value is selected to ensure uniform charging output and to prevent any undesirable print defects from occurring. As an example, the BDP spots defect is known to occur for charging actuator values within some small delta or range above the charging knee. In embodiments, the chosen delta between the charge knee and the desired actuator setting is chosen to be slightly above the threshold for the occurrence of the BDP spots defect. Furthermore, this delta between the charge knee and the chosen actuator setting is preferably variable with the knee value, or with other measurements of the process. For instance, the threshold for the occurrence of the BDP spots defects is known to vary with the thickness of the PC. Thus, careful adjustment of the desired distance between the knee and the charging actuator value as a function of the estimated thickness of the photoconductor could enable the charging actuator to ride just above the threshold for BDP spots, thereby ensuring a minimum actuator value and maximizing PC life. In a simple embodiment, this approach could be implemented merely by estimating the PC thickness based only on the number of prints that have been made by the print engine and using an experimentally derived equation relating print count to PC thickness. A similar embodiment could use the number of cycles of the photoconductor as the indicator for deriving PC thickness. Preferably, the photoreceptor thickness is determined in situ with the BTR or the BGR using methods such as those disclosed, for example, in U.S. patent application Ser. No. 11/644,277 incorporated by reference above. In this way, the delta between the charging knee and the chosen charging actuator can be adjusted appropriately to maintain a minimum value while achieving acceptable output print quality. In other embodiments, the charge knee voltage can be directly measured using a variety of sensing mechanisms, including using an in-situ electrostatic voltmeter (ESV) or using the charging device as an ESV as disclosed, for example, in U.S. patent application Ser. No. 11/644,277 incorporated by reference above.

A preferred method of feedback sensing for the charge device controller in other embodiments could also be a direct measure of the output print uniformity. This type of sensing could be achieved using, for example, an optical array sensor, such as a scan bar or the like to scan printed sheets or even printed images on an image bearing member, such as the ITB, a photoconductor, or other image bearing member. This sensor would enable direct measurement of the BDP spots defect and therefore would provide sufficient feedback information to enable minimization of the charger settings without impacting output print quality. Once the knee actuator voltage value and some measurements of the charging uniformity or output print quality performance are known, the AC charging actuator can be adjusted so as to maintain the output print quality of the xerographic machine while also extending the life of the photoreceptor according to embodiments.

As indicated above, the location of the knee of the charge curve will change as a function of a variety of disturbances. For instance, as the PC surface wears and becomes thinner, the location of the knee of the charge curve is known to change. In addition, other disturbances such as the temperature of the PC and BCR will affect the location of the charge curve knee. Likewise, the location of the thresholds for the occurrence of charging related print quality defects, such as BDP spots, are also typically not static throughout the life and operation of the printing system. It is because of these factors affecting the location of the charge knee and the actuator thresholds for charging related print quality defects that an optimal, static value for the charging actuator can not be determined at design time. Instead, as outlined in this disclosure, the charging actuator must be actively adjusted as the printer is operating in order to ensure maximum PC life while also guaranteeing acceptable output print quality. Most of the disturbances that affect the charging behavior, and therefore the location of the charge knee and the occurrence of charging related print quality defects, are fairly slow in nature, it typically taking hundreds or thousands of prints for the charge knee to move appreciably. As a result of the slow charge knee location change, the charging controller must sample the charging performance and make adjustments to the actuator value at a fairly low rate to implement embodiments.

Figure 7:
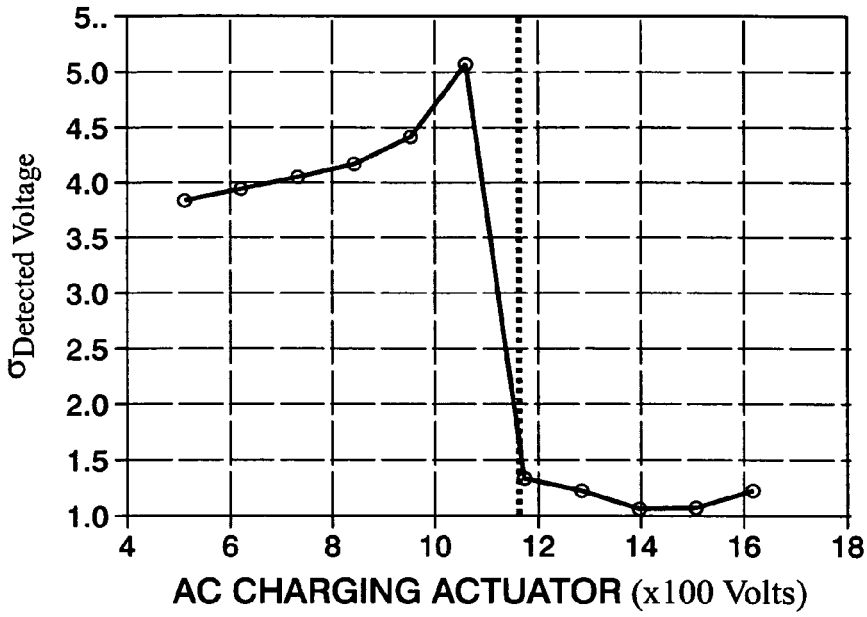
FIG. 7 is a graph of standard of deviation in detected voltage versus AC charging actuator (voltage).

Rather than measuring the knee voltage value directly and using this as the basis for calculating the required charging actuator setting, the noise level in the $V_{high}$ voltage, as indicated by standard deviation, can be used to determine the desired operating point for the AC charging actuator. This can be done with an ESV, if present, or with a biased transfer roller or biased charging roller as suggested in U.S. patent application Ser. No. 11/644,277 and U.S. Pat. No. 6,611,665. Referring again to FIG. 9, a sweep of the AC actuator (block 940) produces a photoreceptor surface voltage response similar to that shown in FIG. 4. In this data, the voltage values reported can be averaged over a very large area to reduce the noise level in the resultant signal. However, rather than averaging to remove the non-uniformity seen by the voltage sensor, it is possible to use this non-uniformity information as a signal of interest using the standard deviation. Plotting the standard deviation of the voltage detector signal as a function of the AC charging actuator 941 yields a curve similar to that shown in FIG. 7. The dotted vertical line in FIG. 7 indicates the position of the knee of the charging curve, as measured using an electrostatic voltmeter (ESV). From this plot, it can be seen that there is a step change in the non-uniformity in the PG charge level as measured by the voltage detector at the knee value. Determining at what voltage value the step occurs 942 by analysis of the standard deviation curve can then be used by the controller to determine an optimal point at which to operate the AG charging actuator. The controller of embodiments preferably attempts to minimize the charging actuator while maintaining a large enough actuator setting to prevent the noise level of the standard deviation sensor from increasing substantially. This type of sensing scheme could be enabled using a fairly inexpensive sensor, as the absolute accuracy of the sensor would be less important since careful measurement of the location of the charge curve knee is not required. Using this sort of technique, it would still be necessary to maintain a sufficient charging actuator to prevent non-uniformities from occurring in the output prints. Because the BDP spots are relatively small defects, a large number of the spots would likely be present before the voltage detector would be sensitive to their presence. Thus, a slightly more conservative setting than that implied by the voltage detector data would likely need to be taken early in the life of the PC to minimize the BDP spots defect. This more conservative setting could still be substantially lower than the typical AC charging actuator operating point in many cases, however. Furthermore, since the occurrence of the BDP spots defect appears to be related to the age of the photoconductor device, where older PC devices seem much less susceptible to the BDP spots defect, it would be possible to reduce the AC actuator setting even further once a threshold of page count has been reached for the PC device of interest.

Another method for obtaining feedback for the charging controller without the use of a voltage detector of any kind would be to analyze the output of the machine for various AC charger settings. For example, the machine can obtain feedback directly from a user. Referring again to FIG. 9, the machine can print a set of calibration sheets using various AC charger settings to print each page 950. The machine can request user evaluation and entry of most acceptable sheet 951, preferably the lowest charger setting that the user deems as having produced acceptable print quality. The controller can then set the actuator to the value associated with the selected sheet 952.

To avoid user intervention, a linear optical array sensor, or full-width array (FWA) as it is sometimes called, is another possible sensing scheme for use with the proposed charging controller. Using an in-situ scan-bar type sensor, it is possible to obtain images of the mass patterns at desired locations within the machine. This can be on an intermediate substrate, such as an intermediate transfer belt, or directly on the media prior to exit from the machine. Thus, after the system prints sheets 950, or at least images them on an intermediate substrate within the print engine, it scans the sheets/images with a FWA 953. The system analyzes the data from the FWA to detect various kinds of charging related non-uniformities, including BDP spots defects, against stored predetermined criteria 954 and uses the setting associated with the most acceptable scanned image 952. Using a sensor of this type, it be possible to automatically sense and track the occurrence of charging related defects and to adjust the charging actuators appropriately without requesting user assistance.

When the charging knee value is used, with reference to FIG. 10, a method for finding the knee value 1000 can start 1010 by determining photoreceptor surface voltage for a plurality of values of the peak-to-peak voltage, $V_{p-p}$, below the knee 1020. These measurements can be made using a biased charging roller 1021, a biased transfer roller 1022, an ESV 1023, or any other method that will provide suitably accurate measurements of surface voltage. Using the measurements below the knee, a best fit line can be "drawn" 1024 representing the sloped portion of the surface potential versus $V_{p-p}$ curve. Additional surface measurements can be made above the knee 1025, and a best fit line can be "drawn" for the above-the-knee values 1026. The intersection point of the best fit lines determines the location of the knee 1027, ending the determination routine 1040. As discussed above, the biased charging roller can be used as an electro-dynamic voltmeter using the methods disclosed in co-pending U.S. patent application Ser. No. 11/644,277, filed on the same date as this application, to measure the photoreceptor surface voltage, $V_{PC}$. Alternatively, a biased transfer roller can be used to measure surface voltage as disclosed in U.S. Pat. No. 6,611,665. Of course, if the xerographic apparatus is equipped with an ESV, the ESV can be used to conduct these measurements of photoreceptor surface potential.

As an alternative to finding the intersection point of the best fit lines as described above, the knee voltage, $V_{p-p,\ knee}$, can instead be determined from the threshold voltage, which can be found using the y-intercept of the sloped portion (below the knee) of the photoreceptor surface voltage vs. peak-to-peak voltage curve as seen in FIG. 4. In this alternative according to embodiments, the below-the-knee best fit line 1024 is extended to determine the intercept value of the below-the-knee best fit line on the surface voltage axis 1028. The intercept value, $V_{PC\ (intercept)}$, can then be used to find the threshold voltage knee voltage using the formula $V_{TH}=2*(V_{DC}-V_{PC\ (intercept)})$ 1029, where $V_{DC}$ is the DC bias applied to the biased charging roller shaft. The knee value is then figured using the formula $V_{knee}=2*V_{TH}$ 1030 1030.

Figure 10A:
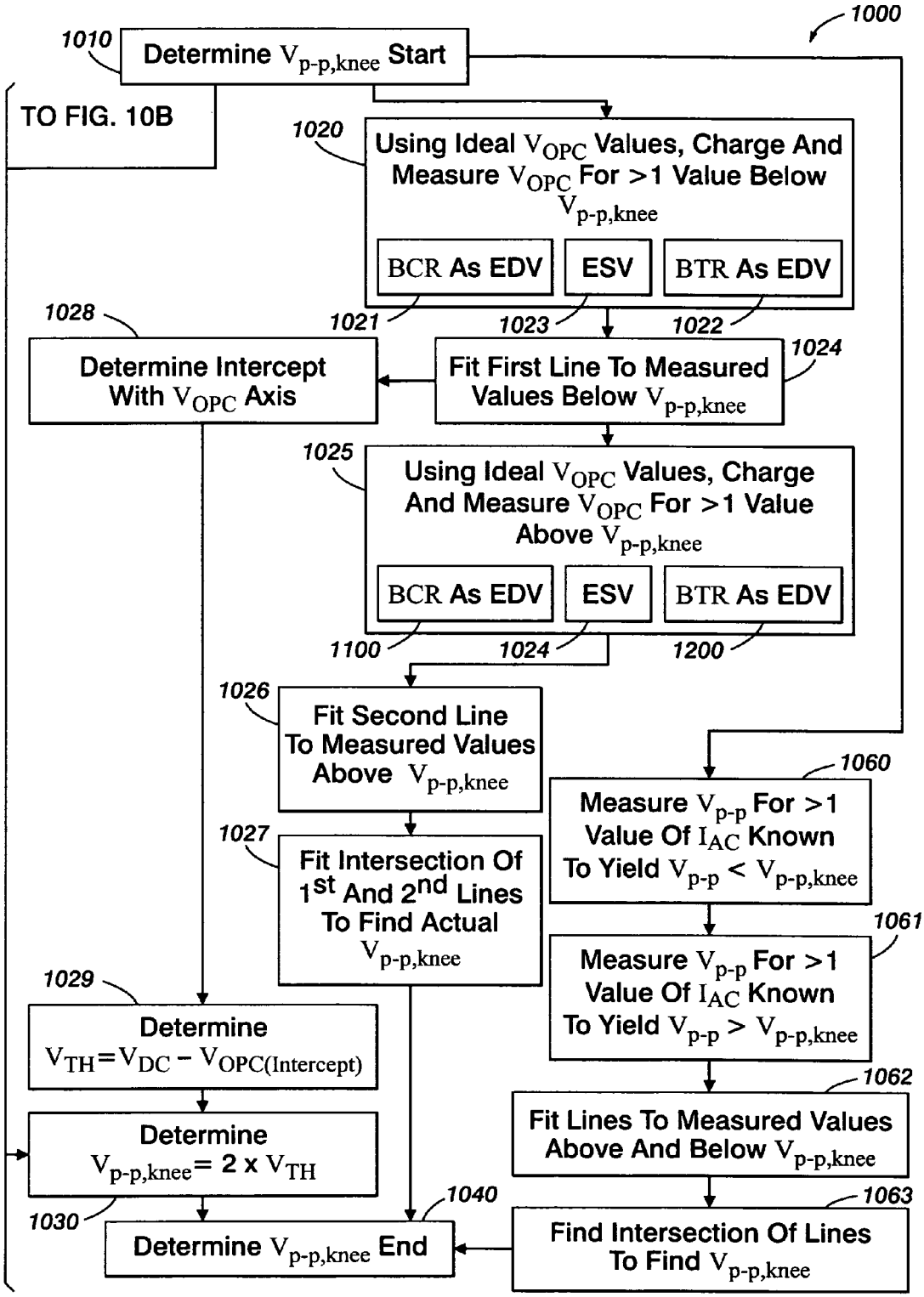
FIG. 10 is a schematic flow diagram of a method of determining $V_{p-p,\,knee}$ according to embodiments.
Figure 10B:
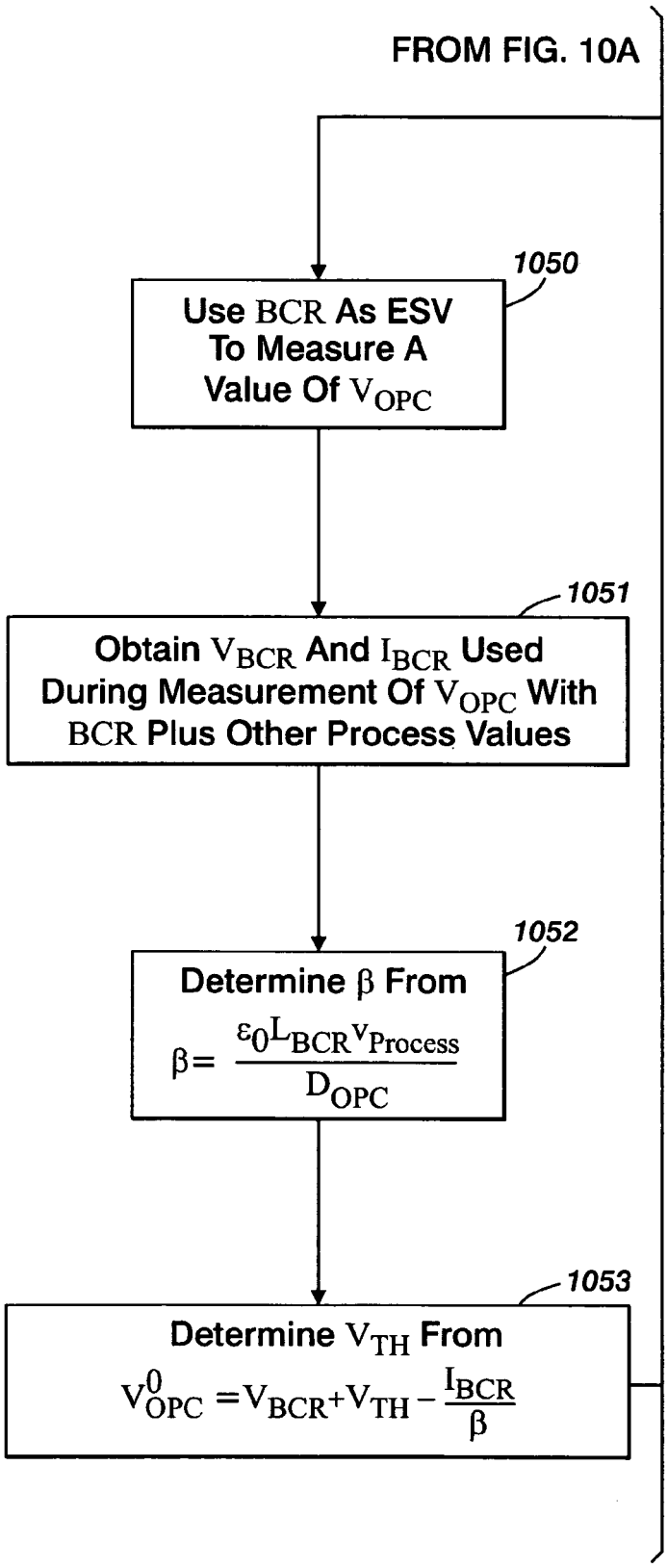

An additional alternative for finding $V_{p-p,\ knee}$ is shown in FIG. 10 with reference to FIG. 8. FIG. 8 shows actuator current versus $V_{p-p}$. The alternative begins by measuring $V_{p-p}$ for at least two current values for the charging actuator below the knee 1060 and at least two current values above the knee 1061. The alternative continues by fitting lines to the measured values above and below the kneed 1062. Finding the intersection point of the lines 1063 yields the value of $V_{p-p,\ knee}$ 1040.

In summary, embodiments provide a method for improving the life of the PC in a xerographic system through active adjustment of the AC charger settings. In particular, charge deposition of undesirable species from contact and/or close proximity AC charging devices, which significantly affects the rate of wear of the PC surface, can be significantly reduced through reduction in the aggressiveness of the AC charging actuators according to embodiments. Embodiments thus actively adjust the AC charging actuators to substantially reduce photoconductor wear while preventing undesirable print quality or other side-effects as necessary to ensure robust charging performance at all times.

It will be appreciated that various of the above-disclosed and other features and functions, or alternatives thereof, may be desirably combined into many other different systems or applications. It will also be noted that various presently unforeseen or unanticipated alternatives, modifications, variations or improvements therein may be subsequently made by those skilled in the art which are also intended to be encompassed by the following claims.

What is claimed is:

1. In a xerographic apparatus including a photoreceptor, a photoreceptor charging subsystem, an imaging subsystem, and a transfer subsystem, a method of photoreceptor life extension and output optimization comprising adjusting an AC charging actuator of the xerographic apparatus to an optimal value at which positive charge deposition is minimized while substantially eliminating print quality defects, the adjusting comprising:

determining the optimal value by determining a knee voltage value of a photoreceptor surface potential versus peak-to-peak voltage curve;

adding a derived interval to the knee voltage value; and setting the optimal value of the charging actuator corresponding to the knee voltage value plus the predetermined interval.

2. The method of claim 1 wherein determining a knee voltage value further comprises charging the photoreceptor with a target potential below the knee value, measuring actual surface potential, repeating charging and measuring to obtain a plurality of points below the knee, and fitting a first line to the plurality of points below the knee.

3. The method of claim 2 further comprising:

charging the photoreceptor with a target potential above the peak-to-peak voltage knee;

measuring the actual surface potential;

repeating charging and measuring to obtain a plurality of actual surface potential points above the knee;

fitting a second line to the plurality of points above the knee; and finding an intersection of the first and second lines to find an actual peak-to-peak voltage knee value.

4. The method of claim 1 further comprising:

generating a photoreceptor surface potential versus peak-to-peak voltage curve for a sweep of the AC charging actuator; determining and plotting standard deviation versus AC charging actuator value;

determining the location of a significant shift in the standard deviation value;

determining an AC charging actuator value corresponding to the knee voltage value; and adding a predetermined interval to the corresponding knee voltage value to obtain the optimal value.

5. The method of claim 4 wherein the predetermined interval is a percentage of the corresponding value.

6. The method of claim 4 wherein the predetermined interval is a stored value.

7. The method of claim 1 wherein determining a knee voltage value comprises:

charging the photoreceptor using at least two first current values that yield peak-to-peak voltage values below the knee voltage value;

measuring first peak-to-peak voltage values for each of the at least two first current values;

charging the photoreceptor using at least two second current values that yield peak-to-peak voltage values above the knee voltage value;

measuring second peak-to-peak voltage values for each of the at least two second current values;

fitting lines to the first and second peak-to-peak values;

determining a peak-to-peak value at an intersection point of the lines; and setting the knee voltage value to the intersection point peak-to-peak value.

8. In a xerographic apparatus including a photoreceptor, a photoreceptor charging subsystem, an imaging subsystem, and a transfer subsystem, a method of photoreceptor life extension and output optimization comprising adjusting an AC charging actuator of the xerographic apparatus to an optimal value at which positive charge deposition is minimized while substantially eliminating print quality defects, wherein the adjusting comprises:

creating a plurality of print images at respective values of the AC charging actuator;

evaluating the print images for acceptability;

selecting the most acceptable image with a minimum corresponding AC charging actuator value; and selecting the minimum corresponding AC charging actuator value as the optimal value.

9. The method of claim 8 wherein creating a plurality of print images comprises printing the print images on a substrate, evaluating the print images comprises soliciting user assessment of the substrate-printed images, and soliciting user entry of a value associated with the most acceptable substrate-printed image.

10. The method of claim 8 wherein evaluating the print images comprises scanning the print images with an optical sensor mounted in the xerographic apparatus and evaluating the print images using stored predetermined criteria.

11. In a xerographic apparatus including a photoreceptor, a photoreceptor charging subsystem, an imaging subsystem, a transfer subsystem, and an optical array sensor, the photoreceptor charging subsystem comprising an AC charging actuator, a photoreceptor life extension and output optimization method comprising determining an optimal value of the AC charging actuator at which output defects and photoreceptor wear are substantially minimized and adjusting the AC charging actuator after installation by adopting the optimal value as an operating value of the AC charging actuator, wherein the determining comprises printing a plurality of calibration sheets using corresponding values of the AC charging actuator, scanning the calibration sheets with the optical array sensor, evaluating the plurality of calibration sheets using stored predetermined criteria, selecting a most acceptable of the plurality of calibration sheets, and setting the AC charging actuator value corresponding to the most acceptable calibration sheet as the optimal value.

12. In a xerographic apparatus including a photoreceptor, a photoreceptor charging subsystem, an imaging subsystem, a transfer subsystem, the photoreceptor charging subsystem comprising an AC charging actuator, a photoreceptor life extension and output optimization method comprising determining an optimal value of the AC charging actuator at which output defects and photoreceptor wear are substantially minimized and adjusting the AC charging actuator after installation by adopting the optimal value as an operating value of the AC charging actuator, wherein determining an optimal value comprises determining a knee value of a photoreceptor surface potential vs. peak-to-peak voltage curve, adding a predetermined interval to the knee value to obtain an optimal voltage, and setting the AC charging actuator to a value corresponding to the optimal voltage, the corresponding value comprising the optimal value.

13. The method of claim 12 wherein the AC charging actuator is AC voltage and the corresponding value is the optimal value.

14. The method of claim 12 wherein the AC charging actuator is AC current and the corresponding value is a current value corresponding to the optimal voltage.

15. The method of claim 12 wherein determining the knee value comprises generating a photoreceptor surface potential versus peak-to-peak voltage curve for a sweep of the AC charging actuator, determining and plotting standard deviation versus AC charging actuator value, determining the location of a step change in the standard deviation value, determining an AC charging actuator value corresponding to the step in the standard deviation to obtain a corresponding voltage value, the corresponding voltage value being the knee value.

16. The method of claim 12 further comprising providing an optical array sensor and wherein determining the optimal value comprises printing a plurality of calibration images on an image bearing member with respective AC charging actuator values, scanning each calibration image with the optical array sensor, evaluating the plurality of calibration images using stored predetermined criteria, selecting a most acceptable of the plurality of calibration images, and setting the AC charging actuator value corresponding to the most acceptable calibration image as the optimal value.

17. The method of claim 16 wherein printing a plurality of calibration images on an image bearing member comprises printing the images on an intermediate transfer belt of the xerographic apparatus.

18. In a xerographic apparatus including a photoreceptor, a photoreceptor charging subsystem, an imaging subsystem, and a transfer subsystem, a method of photoreceptor life extension and output optimization comprising adjusting an AC charging actuator of the xerographic apparatus to an optimal value at which positive charge deposition is minimized, thereby reducing photoreceptor wear rate without inducing any print defects, the AC charging actuator being determined by:

determining a knee voltage value of a photoreceptor surface potential versus peak-to-peak voltage curve;

adding a predetermined interval to the knee voltage value;

storing a first optimal value of the charging actuator corresponding to the knee voltage value plus the predetermined interval; generating a photoreceptor surface potential versus peak-to-peak voltage curve for a sweep of the AC charging actuator;

determining and plotting standard deviation versus AC charging actuator value;

determining the location of a significant shift in the standard deviation value;

determining an AC charging actuator value corresponding to the step in the standard deviation to obtain a corresponding value;

adding a predetermined interval to the corresponding value to obtain a second optimal value;

storing the second optimal value;

creating a plurality of print images at respective values of the AC charging actuator;

evaluating the print images for acceptability;

selecting the most acceptable image with a minimum corresponding AC charging actuator value;

selecting the minimum corresponding AC charging actuator value as a third optimal value; and selecting a minimum of the first, second, and third optimal values as the AC charging actuator value.

* * * * *